US006299080B1

(12) United States Patent
Freemire

(10) Patent No.: US 6,299,080 B1
(45) Date of Patent: Oct. 9, 2001

(54) LOWER GRINDER PUMP TANK

(76) Inventor: Roy S. Freemire, 2257 Fawn Haven Ct., Eldersburg, MD (US) 21784

( * ) Notice: Subject to any disclaimer, the term of this patent is extended or adjusted under 35 U.S.C. 154(b) by 0 days.

(21) Appl. No.: 09/289,467

(22) Filed: Apr. 9, 1999

Related U.S. Application Data

(60) Provisional application No. 60/081,134, filed on Apr. 9, 1998.

(51) Int. Cl.[7] ..... B02C 18/40

(52) U.S. Cl. ..... 241/46.02; 241/100; 241/101.2

(58) Field of Search ..... 241/46.02, 46.06, 241/100, 101.2

(56) References Cited

U.S. PATENT DOCUMENTS 3,920,550 * 11/1975 Farrell, Jr. et al ..... 261/64.1
4,014,475 * 3/1977 Grace et al. ..... 241/36
4,822,213 * 4/1989 Grace et al. ..... 241/46.02 X
4,904,387 * 2/1990 Jordan ..... 210/605
4,919,343 * 4/1990 Luik, Jr. et al. ..... 241/36
5,337,966 * 8/1994 Francis et al. ..... 241/46.06
5,480,548 * 1/1996 Daigger et al. ..... 210/605
5,996,621 * 12/1999 Hagiwara et al. ..... 137/565.33

* cited by examiner

*Primary Examiner*—John M. Husar
(74) *Attorney, Agent, or Firm*—Law Offices of Royal W. Craig

(57) ABSTRACT

An improved horizontally-disposed lower tank for a grinder pump unit, the lower tank being formed of at least one section of corrugated pipe, and at least one aperture formed therein for mounting a grinder pump unit. The lower tank is buried lengthwise in the ground with the aperture(s) directed upwardly. A transition collar is fitted into each aperture of the cylindrical lower tank for mounting grinder pump unit(s) thereon. The lower tank is buried lengthwise in the ground. The horizontally-disposed lower collection tank can accommodate one or more grinder pump units mounted to the inside of the single collection tank, and readily available parts (such as, for instance, the Series 2000—60 gallon tank e.g., from Environment One Corp.) can be used for the grinder pump unit. The horizontal lower tank creates a storage volume that is far in excess of existing capabilities, and the submerged lower tank is structurally sound and needs no concrete or other reinforcement, thereby lowering the cost of both manufacturing and installation.

20 Claims, 10 Drawing Sheets

LOWER GRINDER PUMP TANK

CROSS-REFERENCE TO RELATED APPLICATIONS

The present application is based on provisional application No. 60/081,134 for "LOWER GRINDER PUMP TANK"; filed Apr. 9, 1998.

BACKGROUND OF THE INVENTION

1. Field of the Invention

The present invention relates to sewage grinder pumps and, more particularly, to an improved horizontal lower collection tank assemblage for a grinder pump station that can accommodate one or more grinder pump units mounted to the inside of the single collection tank.

2. Description of the Background

Sewage grinder pump stations are well-known, as exemplified in U.S. Pat. No. 5,562,254 issued to Sleasman et al. On Oct. 8, 1996 (which specification is incorporated by reference herein).

FIG. 1 is a perspective drawing from the '254 patent illustrating the grinder pump station 10, and FIG. 2 is a cross-section drawing from the '254 patent illustrating lower tank portion 16 formed by a cylindrical non-corrugated inner wall 52 and a corrugated outer wall 54.

FIG. 3 illustrates how the prior art grinder pump station 10 of FIGS. 1 and 2 is installed in the ground.

As seen throughout FIGS. 1–3 and as fully described in the '254 patent, this grinder pump station 10 is positioned substantially vertically in the ground. Grinder pump station 10 includes a lid assembly 22, an upper tank portion 14, a transition section 18, a lower tank portion 16, and a base 32. The outer side walls of upper tank portion 14 and lower tank portion 16 are corrugated, while the outer side wall 17 of transition section 18 is smooth. Extending through side wall 17 of transition section 18 is an inlet opening 20 through which sewage enters grinder pump station 10, and a discharge opening 19, through which processed sewage exits grinder pump station 10. Attached to this upper tank portion 14 is a lid assembly 22. Lid assembly 22 includes the electrical and ventilation interfaces of the grinder pump station, as more fully described hereinafter, and an access hatch 24 for allowing interior access. A base 32 is secured to the lower portion 16 of grinder pump station 10. Mounted within grinder pump station 10 is a grinder pump unit 34. Grinder pump unit 34 includes a grinder head 36 for pulverizing sewage. A grinder pump 39 is secured to grinder head 36 for pumping ground sewage through grinder pump station 10. Grinder pump 38 includes a discharge housing 40, which is joined to a discharge outlet pipe 42. A sealed control housing 44 houses the controls for grinder pump 34, and underneath housing 44, a motor housing casting 47 houses an electric motor (not shown) for powering both grinder pump 38 and grinder head 36. Grinder pump unit 34 employs one or more sensing tubes 46 to sense pressure variations by measuring increases in the level of sewage collected in grinder pump station 10. Upon the attainment of a predetermined sewage level, the motor within motor housing casting 47 is energized. The sewage collected in grinder pump station 10 is then be ground by grinder head 36 and is pumped by grinder pump 38 from discharge housing 41 to discharge outlet pipe 42. From discharge outlet pipe 42, the processed sewage travels to a remote location, e.g., to a pressure sewage main and ultimately to a sewage treatment plant. The entire above-described grinder pump unit is commercially available as the Model 2000 Series from Environment One Corp., Schenectady, N.Y.

With particular reference to the tank portions 14 and 16 of grinder pump station 10, it can be seen that the upper tank portion 14 and lower tank portion 16 are identical in every respect apart from their relative height. Both upper tank portion 14 and lower tank portion 16 have a substantially cylindrical non-corrugated inner wall 52 secured to a substantially cylindrical corrugated outer wall 54. The corrugations of the outer wall 54 form a series of alternating crests 56, ridges and troughs 58. Each trough 58 of corrugated wall 54 is secured, during the manufacturing process, to inner wall 52. An extrusion method of manufacture can be employed to form the corrugated configuration, wherein the cylindrical corrugated outer wall 54 and cylindrical inner wall 52 integrally form double walled upper tank portion 14 and lower tank portion 16.

A transition section 18 separates the upper tank 14 from lower tank 16. Transition section 18 is substantially cylindrical in shape, and has a non-corrugated outer wall to facilitate the formation of one or more inlet openings 20 and discharge openings 19 through its sides, and has an enlarged axial opening extending therein. Transition section 18 includes structure for positioning and aligning grinder pump unit 34 in grinder pump station 10. The inner diameter of transition section 18 is defined by the axial opening, and the outer diameter is defined by outer side wall 17. An internal conical wall 118 forms the upper reservoir portion of transition section 18, while conical wall 118 flows inward from the outer diameter to a proximity near the inner diameter of the transition section. The conical shape provides structural stiffness for transition section 18 and facilitates the insertion of grinder pump unit 34 into the axial opening or transition section 18. The grinder pump stations, lower tank portions, and transition sections as described above and as illustrated in the '254 patent are commercially available from Environment One Corp., Schenectady, N.Y.

It is noteworthy that the above-described design is limited to the illustrated vertical/coaxial configuration of the upper and lower tank portions 14 and 16 of grinder pump station 10. This configuration ostensibly allows for easy field height adjustability, in small increments. However, the vertical configuration can only accommodate a single grinder pump unit, and the overall storage volume is very limited. Moreover, FIG. 3 shows the use of concrete reinforcement 143 for the submerged tank. Concrete reinforcement 143 is necessary to support the vertical and coaxial configuration of the upper and lower tank portions 14 and 16. A concrete truck must somehow gain access to the site, and this greatly increases the cost of manufacturing and installation.

SUMMARY OF THE INVENTION

It is, therefore, an object of the present invention to provide an improved horizontal lower collection tank for a grinder pump station that can accommodate one or more grinder pump units mounted to the inside of the single collection tank.

It is another object to allow readily available parts (such as, for instance, the series 2000—60 gallon tank e.g., from Environment One Corp., Schenectady, N.Y.) to be used in a lower tank design with an inlet at the top of the wet well thus creating a storage volume that is far in excess of existing capabilities.

It is another object to facilitate submersion of the tank no matter the volume without the need for concrete or other reinforcement, thereby lowering the cost of both manufacturing and installation.

It is another object to allow the manufacturer to mount as many grinder pumps to a given tank as the project may require, and to thereby increase the discharge rate of the given tank.

According to the present invention, the above-described and other objects are accomplished by providing an improved horizontally-disposed lower tank for a grinder pump unit, the lower tank including at least one section of corrugated pipe, and at least one aperture formed therein for mounting a grinder pump unit. The lower tank is buried lengthwise in the ground with the aperture(s) directed upwardly. A transition collar is fitted into each aperture of the cylindrical lower tank for mounting grinder pump unit(s) thereon.

BRIEF DESCRIPTION OF THE DRAWINGS

Other objects, features, and advantages of the present invention will become more apparent from the following detailed description of the preferred embodiment and certain modifications thereof when taken together with the accompanying drawings in which.

DETAILED DESCRIPTION OF THE PREFERRED EMBODIMENTS

Figure 4:
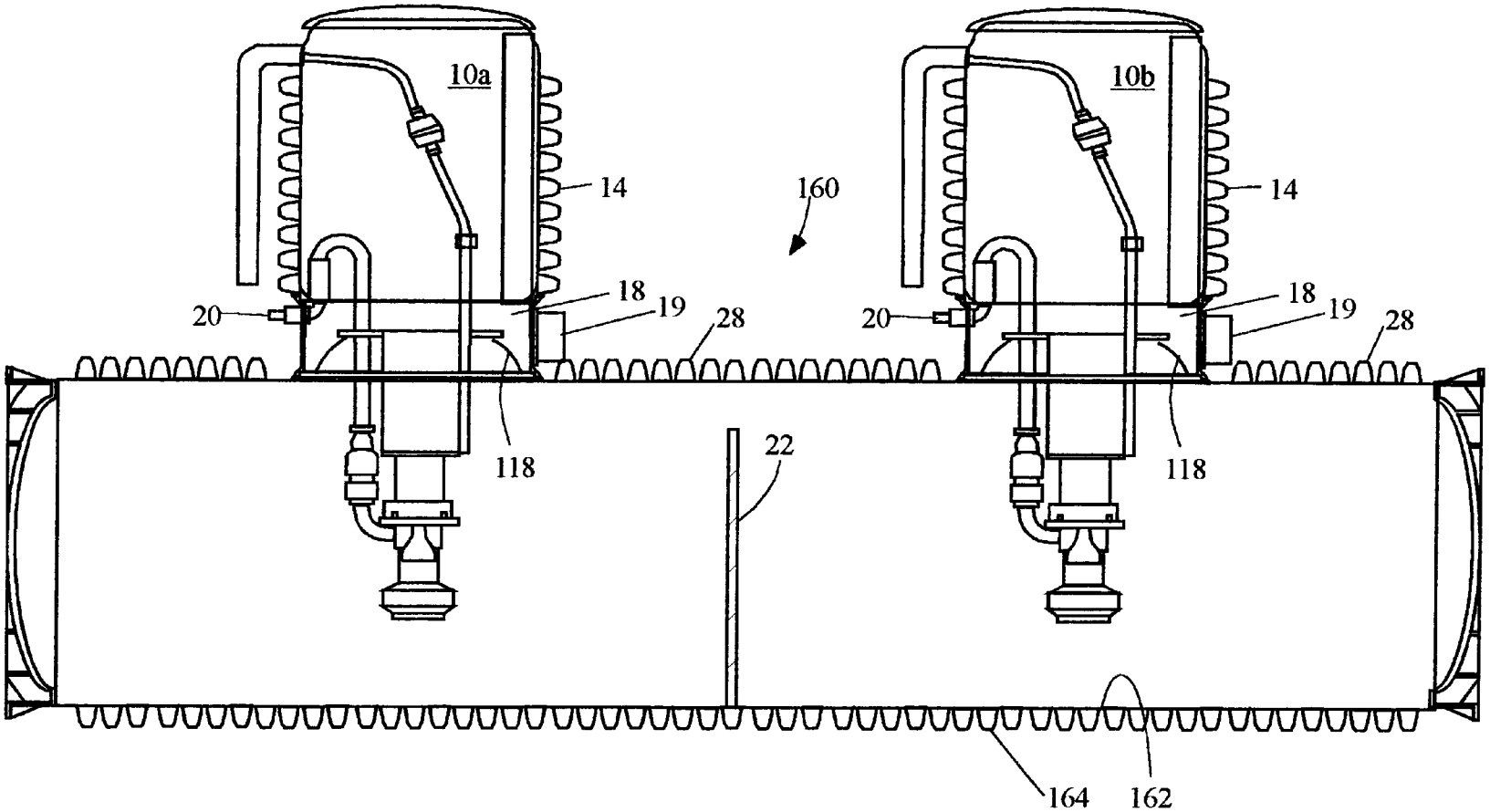
FIG. 4 is a cross-sectional view of an improved lateral-mount lower tank portion 160 with two grinder pump units mounted to the inside according to one embodiment of the present invention.

FIG. 4 is a cross-sectional view of an improved lateral-mount lower tank portion 160 with two grinder pump units 10*a* & 10*b* mounted to the inside according to one embodiment of the present invention.

Figure 1:
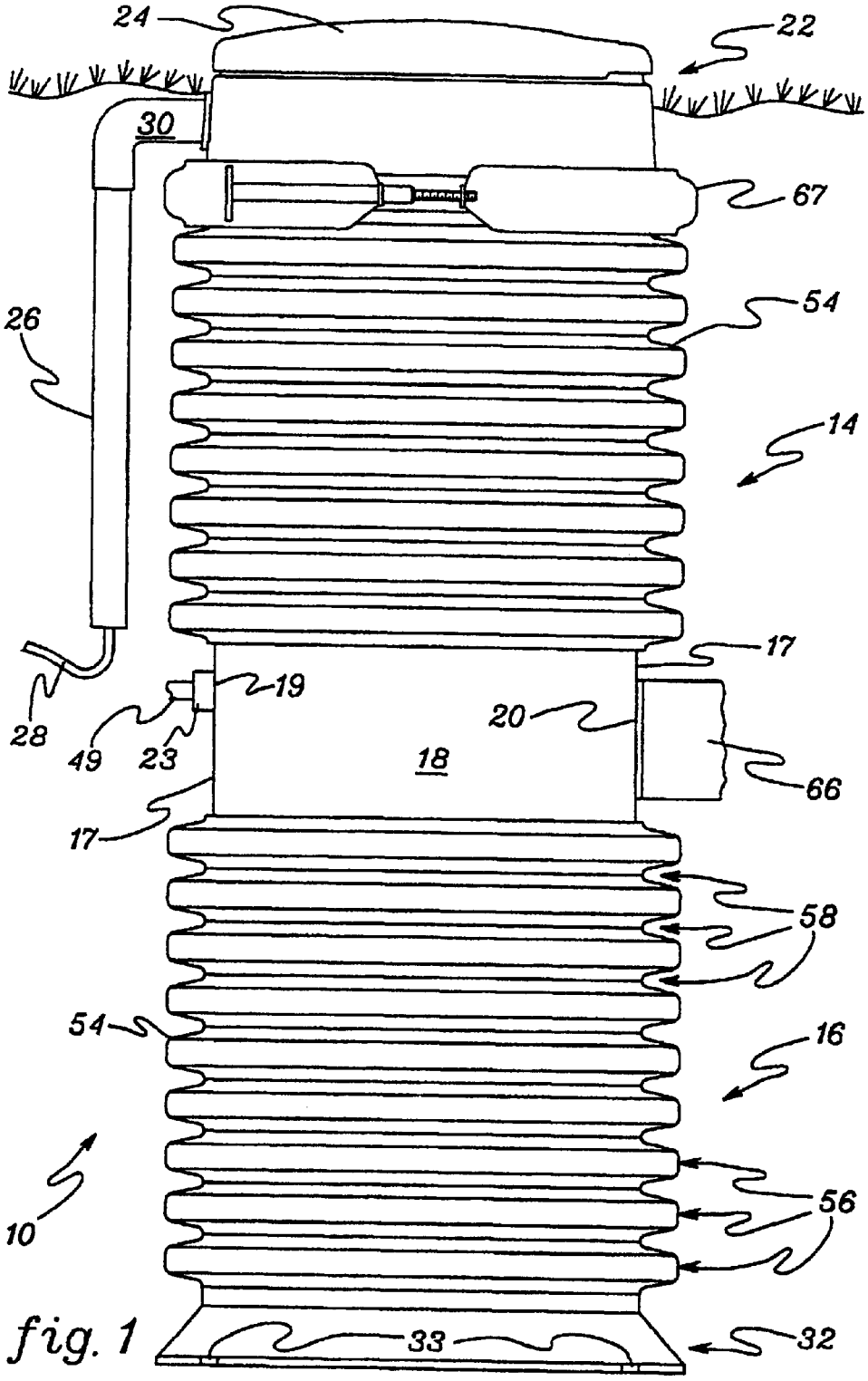
FIG. 1 (Prior Art)
FIG. 1 is a prior art perspective drawing of a grinder pump station 10 having a lower tank portion 16 with a cylindrical non-corrugated inner wall 52 and a corrugated outer wall 54.
Figure 2:
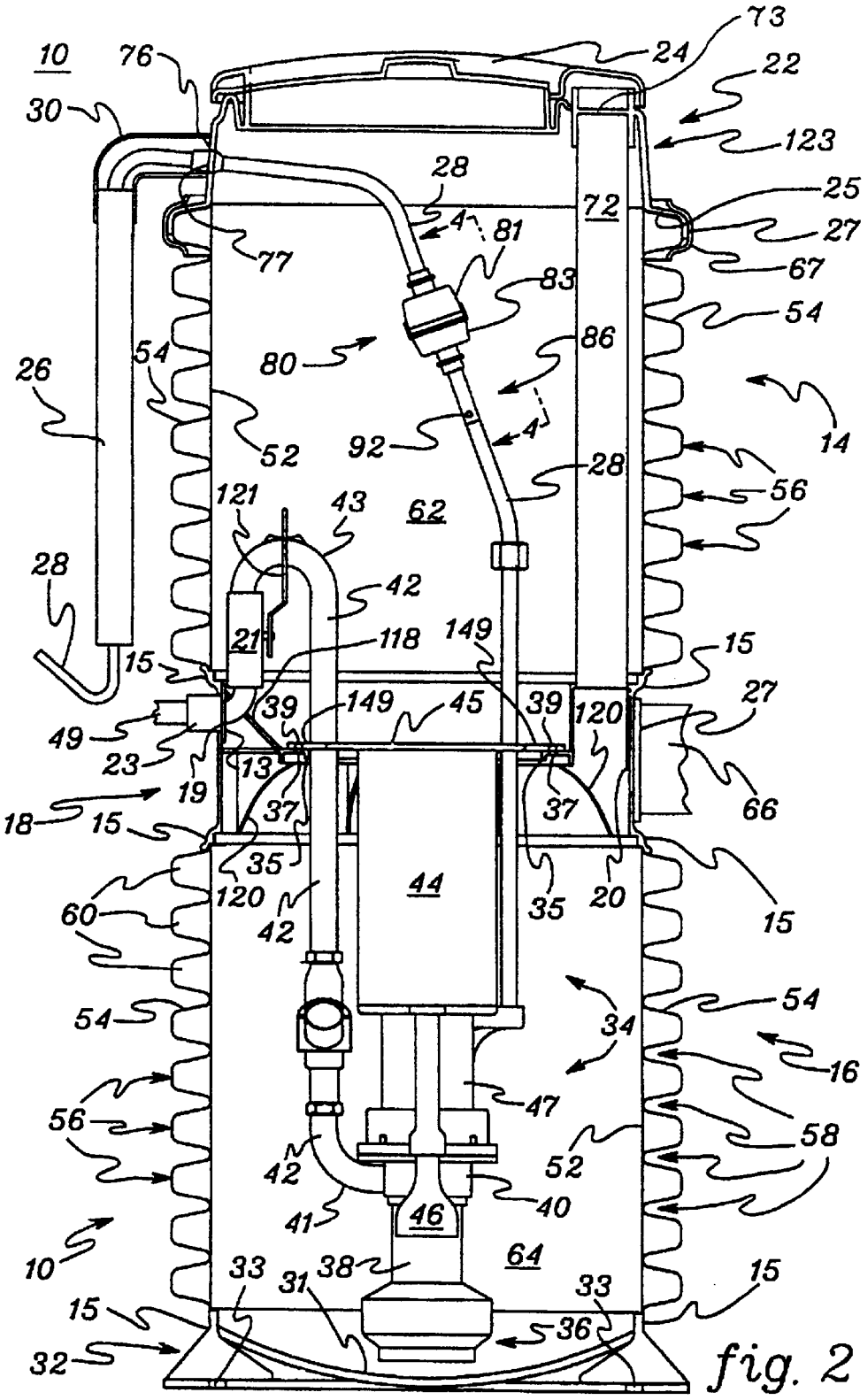
FIG. 2 (Prior Art)
FIG. 2 is a cross-section of the prior art grinder pump station 10 of FIG. 1.
Figures 2, 3:
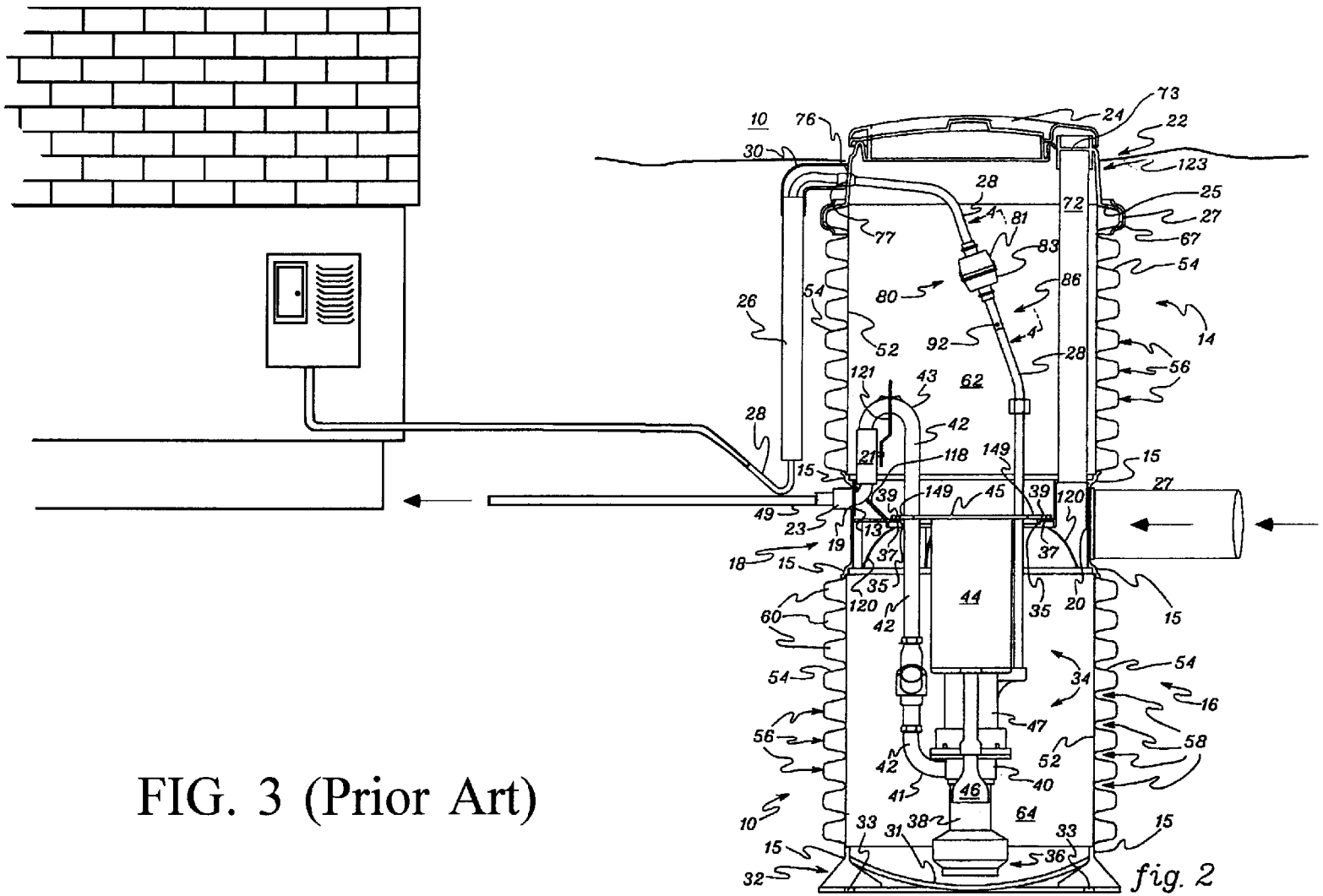
FIG. 3 (Prior Art)
FIG. 3 is a side perspective view illustrating the prior art grinder pump station 10 of FIGS. 1 and 2 as installed in the ground and reinforced by a concrete collar 143.

Both grinder pump stations 10*a* & 10*b* are identical to the grinder pump stations 10 of the above-described '254 patent, and both are readily available components (e.g., the Series 2000 of Environment One Corp., Schenectady, N.Y.). However, rather than a vertical and coaxial configuration of upper and lower tank portions 14 and 16 (as shown in FIGS. 1–3), a modified lower tank portion 160 is configured in the horizontal configuration shown. This results in a horizontal mounting capability, and numerous alternative tank configurations (including the duplex configuration shown) become possible.

Both upper tank portions 14 and lower tank portion 160 are formed in a known manner from a substantially cylindrical non-corrugated inner wall 162 secured to a substantially cylindrical corrugated outer wall 164. The corrugations of the outer wall 164 form a series of alternating crests, ridges and troughs. Each trough of the corrugated outer wall 164 is secured, during the manufacturing process, to cylindrical non-corrugated inner wall 162. Both tank portions 14 and 160 may be constructed from a thermoplastic, such as high density polyethylene. An extrusion method of manufacture can be employed to form the corrugated configuration, wherein the cylindrical corrugated outer wall 164 and cylindrical inner wall 162 integrally form double walled lower tank portion 160. Alternatively, pre-fabricated pipe is readily commercially available, and other wall configurations may be used. For example, smooth wall plastic or fiberglass pipe may be used. In either case a 24" diameter pipe is suitable for the upper tank portions 14, while 36 through 48" diameter pipe is suitable for the lower tank portion 160. The larger diameter lower polyethylene tank 160 is installed horizontally, thus becoming structurally more sound and large enough in both length and width as to not require any concrete collars for either strength or ballast.

The standard 4" inlet 20 and the 1 ¼" discharge 19 of the grinder pump units 10*a* and 10*b* are pre-formed in commercially available products identified as transition sections 18 (these are also available as part number 2010 from Environment One Corp.). The lower tank 160 is defined by two circular upper apertures at positions corresponding to the grinder pump units 10*a* and 10*b*. The transition sections 18 for both grinder pump units 10*a* and 10*b* are fitted into the two upper apertures, and each transition section 18 separates the respective upper tank 14 from lower tank 16. Transition sections 18 are substantially cylindrical in shape, have a non-corrugated outer wall to facilitate one or more inlet or discharge openings 20, and they have an enlarged axial opening inside. Transition sections 18 include structures for positioning and aligning the internal grinder pump mechanisms in grinder pump stations 10*a* and 10*b*. An internal conical wall 118 forms the upper reservoir portion of transition section 18, while conical wall 118 flows inward from the outer diameter to a proximity near the inner diameter of the transition section. The conical wall 118 provides structural stiffness for transition section 18 and facilitates the insertion of grinder pump unit into the axial opening or transition section 18. The single horizontal lower collection tank 160 can accommodate both grinder pump units 10*a* and 10*b* mounted to the inside of the single tank 160. All parts used in the system are readily available, yet the overall storage volume far exceeds existing capabilities. Moreover, the manufacturer can mount as many grinder pumps 10*a*, 10*b* . . . 10–n as desired to a given lower tank 160, thereby increasing the discharge rate of the given tank.

Figure 5:
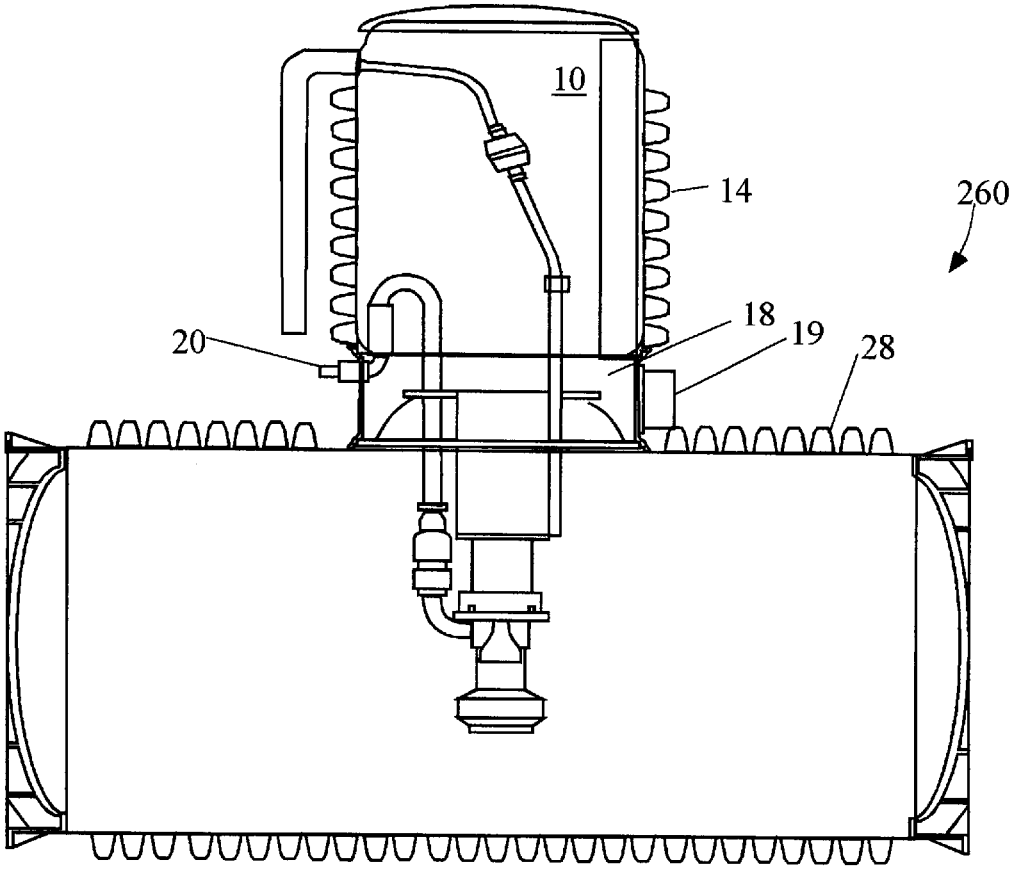
FIG. 5 is a cross-sectional view of another embodiment of the lateral-mount lower tank portion 260 employing larger diameter polyethylene pipe as a simplex pumping station with modifications to allow the single pump to be lowered further into the tank.

FIG. 5 is a cross-sectional view of another embodiment of the lateral-mount lower tank portion 260 employing larger diameter polyethylene pipe (e.g., from 54 to 72" diameter) in a simplex pumping station configuration with modifications to allow a single pump unit 10 to be lowered further into the lower tank 260. The pump unit 10 is lowered further into the tank by the use of a straight piece of polyethylene pipe 30 inserted between the 2010 transition piece 16 and the standard upper tank section 14.

Figure 6:
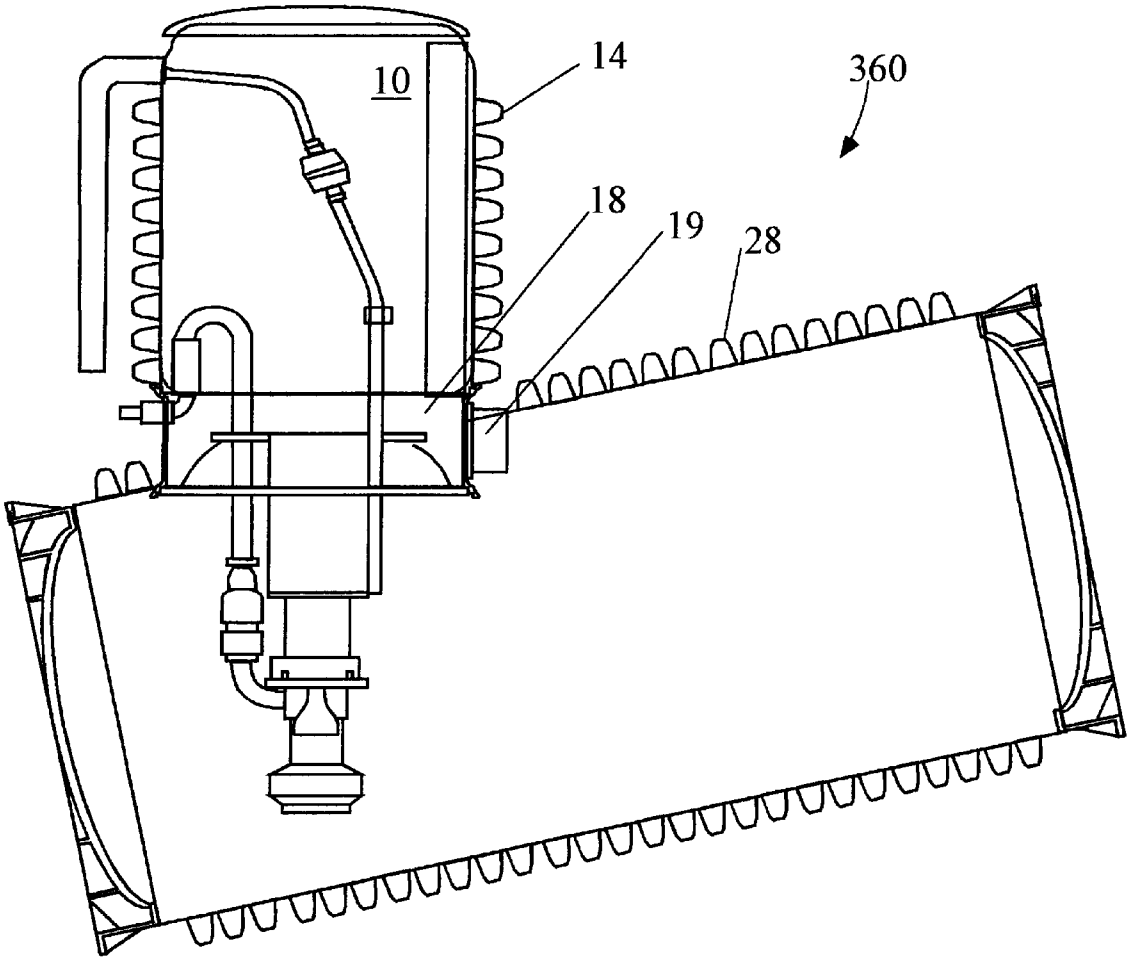
FIG. 6 is a cross-sectional view of another embodiment of an angled lower tank portion 360.

FIG. 6 is a cross-sectional view of another embodiment that employs an angled lower tank portion 360. As in the embodiment of FIGS. 4 & 5, a section of larger diameter polyethylene pipe is used for the lower tank 360 in a simplex pumping station configuration, and an angled aperture is cut at the top of the lower tank 360 such that the transition piece 18 provides an angled ingress into the polyethylene pipe of the lower tank 360. This way, when buried, the larger diameter lower tank 360 is sloped downward to direct sewage toward the pump unit 10.

Figure 7:
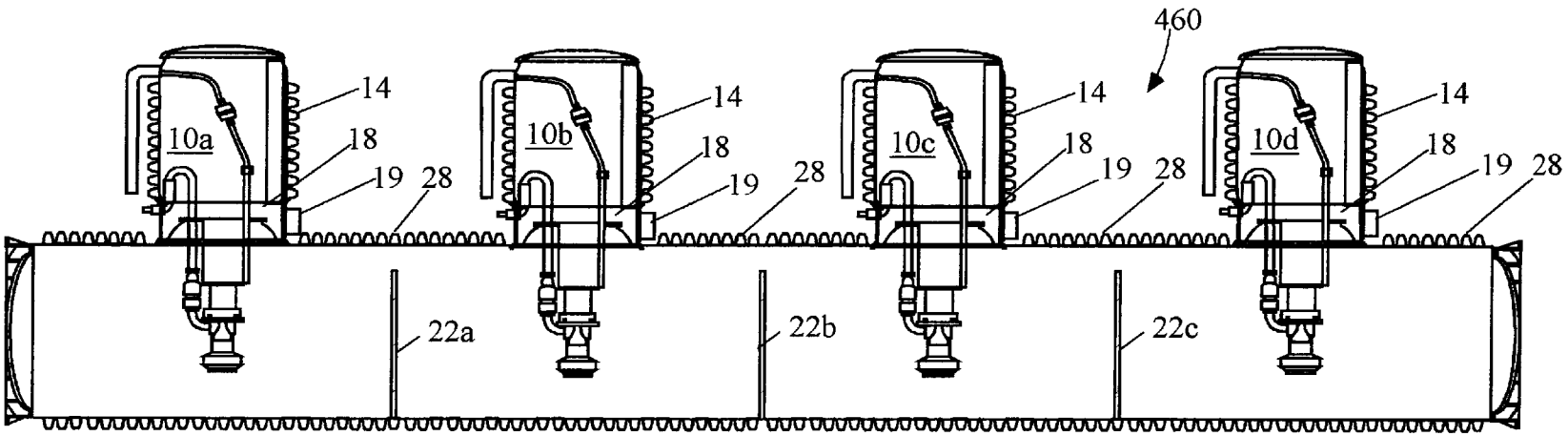
FIG. 7 is a cross-sectional view of the improved lateral-mount lower tank portion 460 with four grinder pump units mounted to the inside according to another embodiment of the present invention.

FIG. 7 is a cross-sectional view of another embodiment of the improved lateral-mount lower tank portion 460 with four grinder pump units 10*a*–10*d* mounted to the inside. A longer section of lower corrugated pipe is used for the lower tank 460 and in conjunction with four transition pieces 18 (e.g., Environment One Corp Model 2010). This illustrates how the use of longer lower tanks 460 enable many more pump units 10 to be installed into a single tank 460. Conventional baffles 22*a*–22*c* may be installed (here one high baffle 22*b* and two low baffles 22*a* and 22*c*), and in this manner the lower tank 460 can be sectioned to operate as a duplex unit with each pair of sectioned pump units 10*a* & 10*b*, 10*c* & 10*d* serving as a backup for each other.

Figure 8:
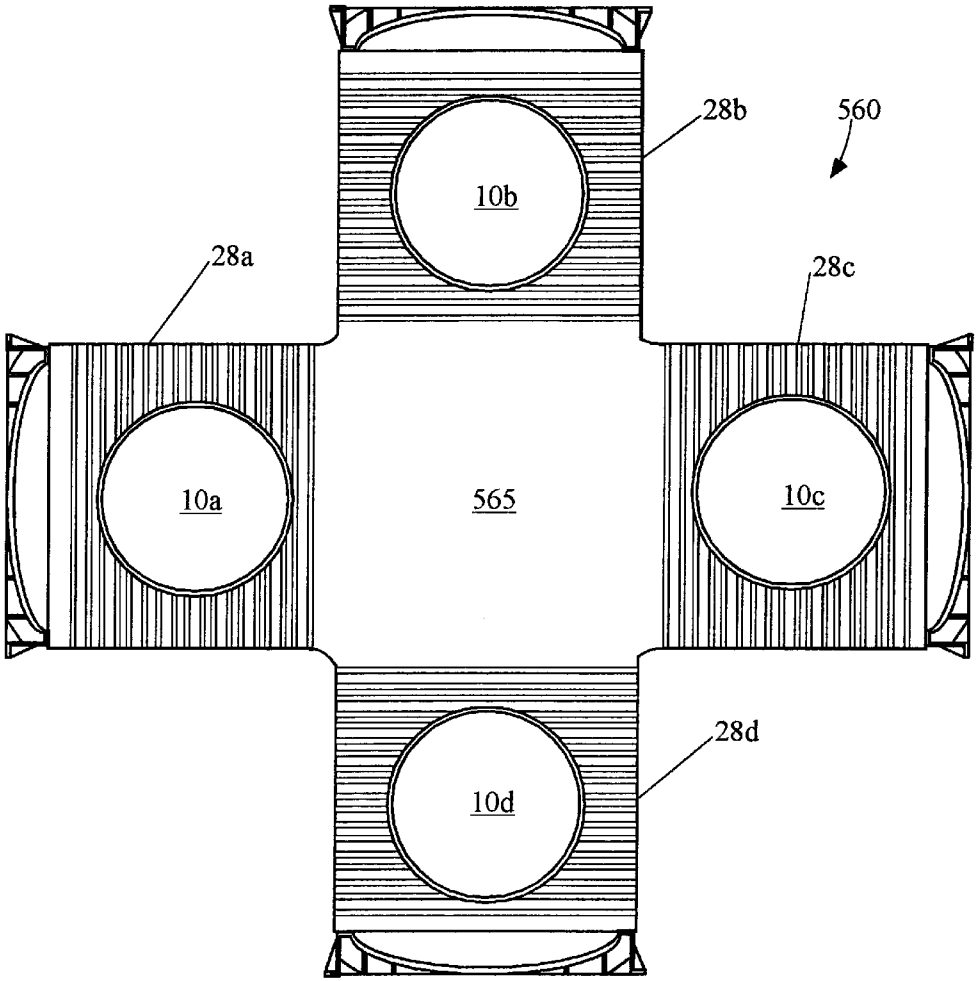
FIG. 8 is a top perspective view of a lateral-mount lower tank portion 560 which employs a cross-fitting to join four separate sections of polyethylene pipe in an "X" configuration, thereby allowing the use of four pumps in a very tight area.

FIG. 8 is a top perspective view of a lateral-mount lower tank portion 560 which employs a cross-fitting 565 to join four separate sections 28*a*–28*d* of polyethylene pipe in an "X" configuration, thereby allowing the use of four pump units 10*a*–10*d* in a very tight area. The cross-fitting 565 may be a conventional polyethylene pipe section having four conduits of the same diameter as the polyethylene pipe sections 18*a*–18*d*.

Figure 9:
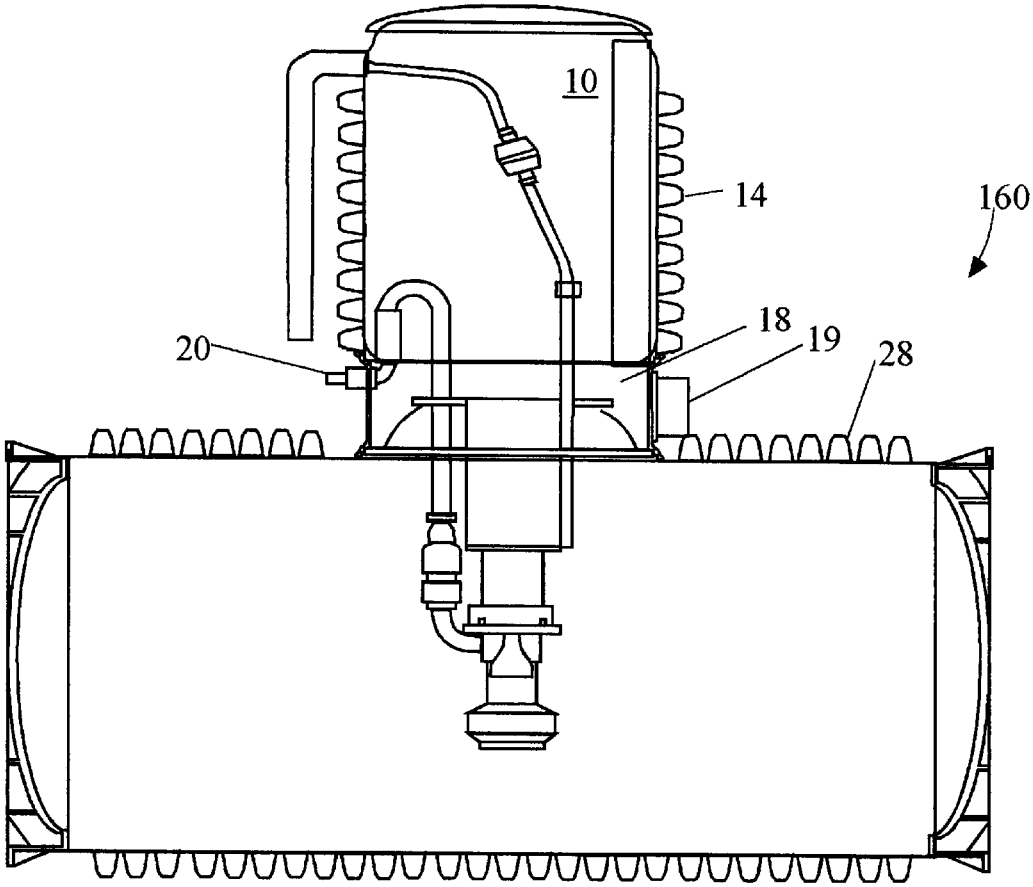
FIG. 9 is a cross-sectional view of a simplex lateral-mount lower tank portion 160 as in the duplex embodiment of FIG. 5, with a more detailed illustration of a conventional transition piece 16.

FIG. 9 is a cross-sectional view of a simplex lateral-mount lower tank portion 160 (as in the duplex embodiment of FIG. 4), with a more detailed illustration of a conventional transition piece 18. The curvature of the large diameter pipe 28 around the aperture proximate the transition piece 18 is shown, whereby the pipe 28 dips enough to allow for the four inch or six inch warp in the transition piece. Therefore, the entire volume of the lower tank 160 is below the aperture so that the entire volume of the lower tank 160 ran be used for storage.

Figure 10:
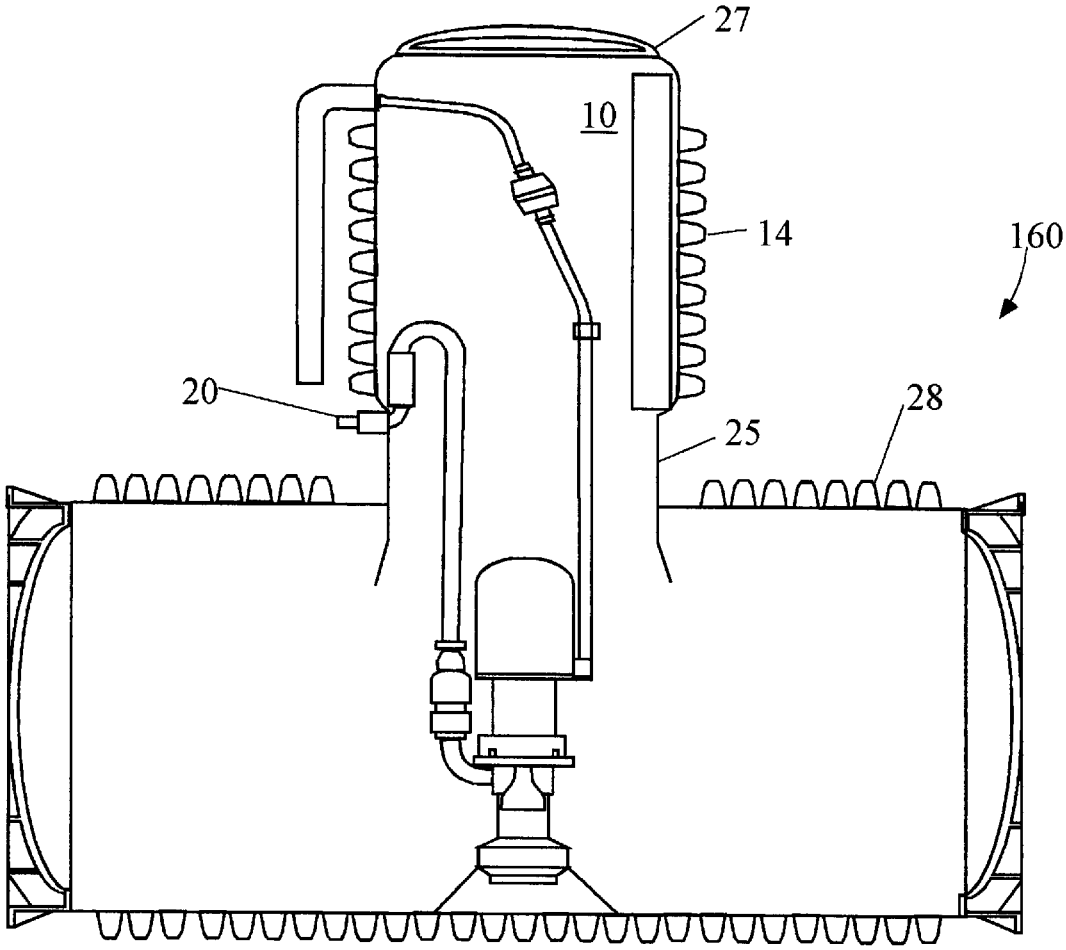
FIG. 10 is a cross-sectional view of a lateral-mount lower tank portion 160 as in FIG. 9 with no transition piece.

FIG. 10 is a cross-sectional view of a lateral-mount lower tank portion 160 as in FIG. 9 with no transition piece at all. Instead, a section of smooth wall polyethylene pipe 25 is employed and an inexpensive lid 27 is used. This configuration can be used with the Environment One AMGP pump or any other submersible pump to achieve a higher flow rate than would otherwise be available.

Having now fully set forth the preferred embodiments and certain modifications of the concept underlying the present invention, various other embodiments of the lateral-mount lower tank as well as certain variations and modifications thereto may obviously occur to those skilled in the art upon becoming familiar with said underlying concept. For instance, the lower tank need not be corrugated high density polyethylene. Alternately, it may be formed of smooth wall plastic or fiberglass pipe. It is to be understood, therefore, that the invention may be practiced otherwise than as specifically set forth herein.

I claim:

1. A sewage grinder pump station, comprising:

a grinder pump unit;

an upper tank formed as a cylindrical section and having a first axis, said upper tank being substantially vertically oriented and closed at the top;

a lower tank in communication with said upper tank, the lower tank being formed from at least one cylindrical section of pipe having a second axis orthogonal to said first axis, and said lower tank having an upward aperture in its perimeter for mounting said upper tank;

whereby said grinder pump unit is housed within said upper tank and lower tank.

2. The sewage grinder pump station according to claim 1, wherein the upward aperture in the lower tank is circular for mounting the cylindrical lower tank vertically thereon.

3. The sewage grinder pump station according to claim 2, whereby said lower tank is buried lengthwise in the ground with said aperture directed upwardly.

4. The sewage grinder pump station according to claim 3, further comprising a transition collar fitted into said aperture of the cylindrical lower tank for mounting the bottom of the cylindrical lower tank.

5. The sewage grinder pump station according to claim 1, further comprising a plurality of grinder pump units, a corresponding plurality of upper tanks each being formed as a cylindrical section, substantially vertically oriented and closed at the top, and a single a lower tank in communication with all of said upper tanks, the lower tank being formed from at least one section of pipe with a plurality of upward apertures therein for mounting said upper tanks.

6. The sewage grinder pump station according to claim 5, further comprising at least one baffle partially subdividing the interior of said lower tank into separate areas for each of said plurality of grinder pump units.

7. The sewage grinder pump station according to claim 5, wherein said single lower tank is formed from a linear section of pipe with a plurality of upward apertures spaced lengthwise for mounting said upper tanks.

8. The sewage grinder pump station according to claim 5, wherein said single lower tank is formed from a union of two linear sections of pipe, thereby forming four chambers each having an upward aperture formed therein for mounting a corresponding upper tank.

9. The sewage grinder pump station according to claim 1, wherein the upward aperture in the lower tank is spherical for mounting the bottom of the cylindrical lower tank at an angle.

10. The sewage grinder pump station according to claim 1, wherein said lower tank further comprises at least one section of corrugated pipe.

11. The sewage grinder pump station according to claim 10, wherein said corrugated lower tank is formed of plastic.

12. The sewage grinder pump station according to claim 11, wherein said corrugated lower tank is formed of high-density polyethylene.

13. The sewage grinder pump station according to claim 10, wherein said corrugated lower tank is formed of fiberglass.

14. A tank for a sewage grinder pump station, comprising an upper tank formed as a substantially vertically oriented cylindrical section closed at the top, and a lower tank formed as a substantially horizontally oriented cylindrical section closed at both ends and coupled to said upper tank.

15. The tank for a sewage grinder pump station according to claim 14, wherein said lower tank is formed from at least one section of pipe with an upward aperture therein for mounting said upper tank.

16. The tank for a sewage grinder pump station according to claim 15, wherein the upward aperture in the lower tank is circular for mounting the cylindrical lower tank vertically thereon.

17. The tank for a sewage grinder pump station according to claim 15, further comprising a transition collar fitted into said aperture of the cylindrical lower tank for mounting the bottom of the cylindrical lower tank.

18. The tank for a sewage grinder pump station according to claim 15, wherein said single lower tank is formed from a union of two linear sections of pipe, thereby forming four chambers each having an upward aperture formed therein for mounting a corresponding upper tank.

19. The tank for a sewage grinder pump station according to claim 14, further comprising a plurality of grinder pump units, a corresponding plurality of upper tanks each being formed as a cylindrical section, substantially vertically oriented and closed at the top, and a single a lower tank in communication with all of said upper tanks, the lower tank being formed from at least one section of pipe, closed at both ends, and with a plurality of upward apertures therein for mounting said upper tanks.

20. The tank for a sewage grinder pump station according to claim 19, further comprising at least one baffle partially subdividing the interior of said lower tank into separate areas for each of said plurality of grinder pump units.

* * * * *